US005427822A

United States Patent [19]

Bracciano

[11] Patent Number: 5,427,822

[45] Date of Patent: Jun. 27, 1995

[54] METHOD AND APPARATUS FOR COATING VEHICLE PANELS

[75] Inventor: Daniel C. Bracciano, Rochester Hills, Mich.

[73] Assignee: General Motors Corporation, Detroit, Mich.

[21] Appl. No.: 270,108

[22] Filed: Jul. 1, 1994

Related U.S. Application Data

[63] Continuation of Ser. No. 61,932, May 17, 1993, abandoned.

[51] Int. Cl.[6] ..... B05D 1/02

[52] U.S. Cl. ..... 427/424; 427/346; 427/425; 118/56; 118/320; 118/326

[58] Field of Search ..... 427/346, 425, 424; 118/56, 320, 326

[56] References Cited

U.S. PATENT DOCUMENTS

| | | | |
|---|---|---|---|
| 223,618 | 1/1880 | Warrington . | |
| 2,036,459 | 4/1936 | Carter | 91/60 |
| 2,544,228 | 3/1951 | Hoppe | 311/62 |
| 2,598,201 | 5/1952 | Williams et al. | 118/416 |
| 2,598,246 | 5/1952 | Fowler | 118/321 |
| 3,380,434 | 4/1968 | Faber | 118/500 |
| 4,450,954 | 5/1984 | O'Connell | 198/793 |
| 4,546,553 | 10/1985 | Best | 34/39 |
| 4,572,081 | 2/1986 | Copeland | 108/17 |
| 4,838,199 | 6/1989 | Weber | 118/500 |
| 4,874,639 | 10/1989 | Matsui et al. | 427/240 |
| 5,079,822 | 1/1992 | Arai et al. | 29/430 |
| 5,169,683 | 12/1992 | Toshiaki et al. | 118/56 |

FOREIGN PATENT DOCUMENTS 63-258678 10/1988 Japan .

OTHER PUBLICATIONS

Abstract of U.S. 5,169,683, division of U.S. 4,874,639.

*Primary Examiner*—Shrive Beck
*Assistant Examiner*—David M. Maiorana
*Attorney, Agent, or Firm*—George A. Grove

[57] ABSTRACT

The invention provides a method and apparatus for coating horizontal and vertical components of a vehicle body. The designations horizontal component and vehicle component generally refer to the in-body position of such components (panels) after final assembly. In the method, coating is conducted prior to assembly of such components. According to one aspect of the invention, the vertical panels are coated in their in-body position, and then moved to a horizontal position while baking sufficiently to set the coating. Preferably, the horizontal position is maintained for the entire bake cycle.

7 Claims, 3 Drawing Sheets

METHOD AND APPARATUS FOR COATING VEHICLE PANELS

This is a continuation of application Ser. No. 08/061,932, filed May 17, 1993, now abandoned.

FIELD OF THE INVENTION

This invention relates to a method of coating vehicle body components in a coating line and an apparatus therefor.

BACKGROUND OF THE INVENTION

Vehicle bodies or components thereof are coated during a series of steps constituting an overall coating process, while the vehicle bodies or components thereof are conveyed along a coating line. In one scenario, a "body frame integral" (BFI) constitutes the car welded together in a complete body which then is advanced on a carrier through the coating line. This is the traditional method.

In another scenario known as "space-frame construction" or "panels off", the exterior components of the vehicle body, namely hood, roof, deck lid, fenders, doors and quarter panels, are coated prior to assembly. These components (panels) are carried on a carriage in their in-body position (the position they will assume after assembly), and taken through the entire coating line in the unassembled in-body position.

The steps conducted in the coating line may involve applying a corrosion protective electrodeposited layer, a primer, an intermediate basecoat comprising pigment with or without flakes or mica, and finally applying a top coat or overcoat, sometimes referred to as a "clear coat", to provide a mirror-like, high gloss finish. Two basic types of basecoats are used today in combination with a clear coat. A basecoat may be water-borne or organic solvent-borne. Typically, a two component isocyanate clear coat or one component melamine composition is applied over the basecoat. The primer, basecoat and clear coat are referred to as "paints" and are applied in a spraying step, each followed by a drying step. The drying step may have two parts: a setting step and a baking step. The setting step is designed to volatilize a solvent typically when a water-based paint is used. The baking step bakes the applied paint at an elevated temperature. In instances where an organic solvent-based paint is used, the drying step usually involves the baking step only, because such solvents are more volatile than water.

All baking is conducted in two basic stages: a first stage to set the applied coating sufficiently to avoid inclusion of or adhesion of dust, and a second stage to cure the coating. The first stage is usually in an infrared oven, and the second stage is usually in a convective baking oven (hot air).

When painting vertical components of the vehicle body, the paint is generally applied with a spray gun from a direction transverse to the surface of the vertical component. Since the surface of the component to be painted is oriented generally vertically, the paint may droop and sag due to gravity so that the thickness of the coating or film formed when the paint is ultimately dried is uneven. Some sagging may occur by influence of gravity when the paint is applied. However, such sagging is more particularly a problem when baking the applied paint. One approach used to overcome this problem is to include rheology control components in the paint, and particularly the top coat, so that the influence of gravity is lessened. Such rheology components basically cause the paint to be thicker, more adhesive to the vertical panels, to have higher viscosity (decreased fluidity), and to have a tendency to level or flow on the panels.

Another alternative for attempting to overcome problems with gravity and paint sagging is as disclosed in U.S. Pat. No. 4,874,639 issued to Matsui et al in 1989, wherein paint is sprayed onto an assembled vehicle body (BFI), and then the entire body is rotated about its horizontal axis until the paint sprayed thereon is set and baked. Such a system requires significant alteration of existing coating lines, spray paint booths and baking ovens in order to accommodate the clearances required to rotate an entire body assembly. In addition, significant mechanical energy is needed to rotate an entire vehicle body having a weight on the order of 1000 pounds to 2000 pounds.

The degree of evenness of the coated surface is a standard which is used to evaluate the quality of the coating. Irregularities in the coated surface, sometimes referred to as "orange peel", may occur. Such irregularities are measured in units called "tension". A rating of 20 tension is equivalent to polished black glass, so that if the surface of a car had a coating which achieved a 20 tension, it would be equivalent to looking in a mirror with no distortion or orange peel.

The rotational bake system presently used includes a double clear coat, where the first clear coat application is sanded to smoothness and then a second clear coat is applied. With the rotational bake system presently in use, it is reported that ratings of up to about 19 tension are achievable, but this rotational bake system requires that a double clear coat be applied while rotating the entire car at significant cost and with total reconstruction of the coating line to accommodate such rotation.

Therefore, what is need is an improved method and apparatus for the coating line.

SUMMARY OF THE INVENTION

The invention provides a method and apparatus for coating horizontal and vertical components of a vehicle body. The designations "horizontal component" and "vehicle component" generally refer to the in-body position of such components (panels) after final assembly. In the method, coating is conducted prior to assembly of such components. According to one aspect of the invention, the vertical panels are coated in their in-body position, and then moved to a horizontal position while baking sufficiently to set the coating. Preferably, the horizontal position is maintained for the entire bake cycle.

During the coating process, the vehicle components are supported on a carriage constructed and arranged to rotate the vertical vehicle components to any desired position between and including a generally horizontal position and a generally vertical position. Preferably, the horizontal components of the vehicle are maintained in a substantially horizontal plane and not rotated. Therefore, as the carriage advances through the coating apparatus, the vertical components are adjusted and readjusted to any desired position. In one alternative, the protective primer and basecoats are applied to the vertical components while oriented in a generally vertical position, and then the vertical components are rotated on the carriage to a generally horizontal position. If desired, the clear coat may be applied while the vertical components are maintained in a horizontal position and may then be baked in that same generally horizontal position.

A preferred carriage for transporting horizontal and vertical vehicle body components includes at least one first fixture carrying a panel in a horizontal position and a second fixture which is moveable to carry a vertical panel in a generally horizontal position, or at an angle to the horizontal position, or in a vertical position. An actuator moves the second fixture from the generally vertical position to a generally horizontal position. The carriage is advanced by conveying means. Preferably, the actuator includes a hinge constructed and arranged to facilitate movement of the second fixture so that it may rotate and dispose vertical panels (components) in a horizontal position, or a vertical position or any position therebetween, and guide means are provided to work in cooperation with the hinge for rotating the second fixture to different angles. Retaining means releasably retain horizontal and vertical vehicle components (panels) on the respective fixtures.

Preferably, the first fixtures are vertical supports of the carriage contoured to retain one or more generally horizontally oriented vehicle components, such as a vehicle hood, roof or deck lid. The second fixtures are moveable supports contoured and designed to releasably retain one or more generally vertically oriented vehicle components, such as a vehicle fender, front door, back door or quarter panel. Preferably, the carriage has a design which is essentially symmetrical so that an entire set of vehicle components may be carried together on the carriage in their essentially in-body position. Therefore, the carriage would essentially have a right side and a left side for carrying respective right vehicle fender, door and quarter panel, and left vehicle fender, door and quarter panel.

Advantageously, the invention permits the baking of all vehicle body components in the horizontal position, does not require moving parts in the bake ovens, provides the equivalent appearance of a double clear coat without the expense of applying a double clear coat, dramatically reduces orange peel, enhances distinctiveness of image, improves gloss, improves smoothness of the finished surface, enhances appearance of depth, enhances matching of color of vertical and horizontal panels, increases dry film thickness, and decreases defects.

Advantageously, existing paint and coating line apparatus may be retro-fitted easily and inexpensively, and the invention does not require major capital investment and does not adversely affect emissions or the environment.

These and other objects, features and advantages will become apparent from the following description of the preferred embodiments, appended claims and accompanying drawings.

BRIEF DESCRIPTION OF THE DRAWINGS

FIG. 1A depicts the process from the mounting of body panels onto a carriage through the wet sanding and washing and blow-off operation. FIG. 1B depicts the last half of the process from the wet sand oven through the final paint bake oven.

DETAILED DESCRIPTION OF THE PREFERRED EMBODIMENTS

Figure 1A:
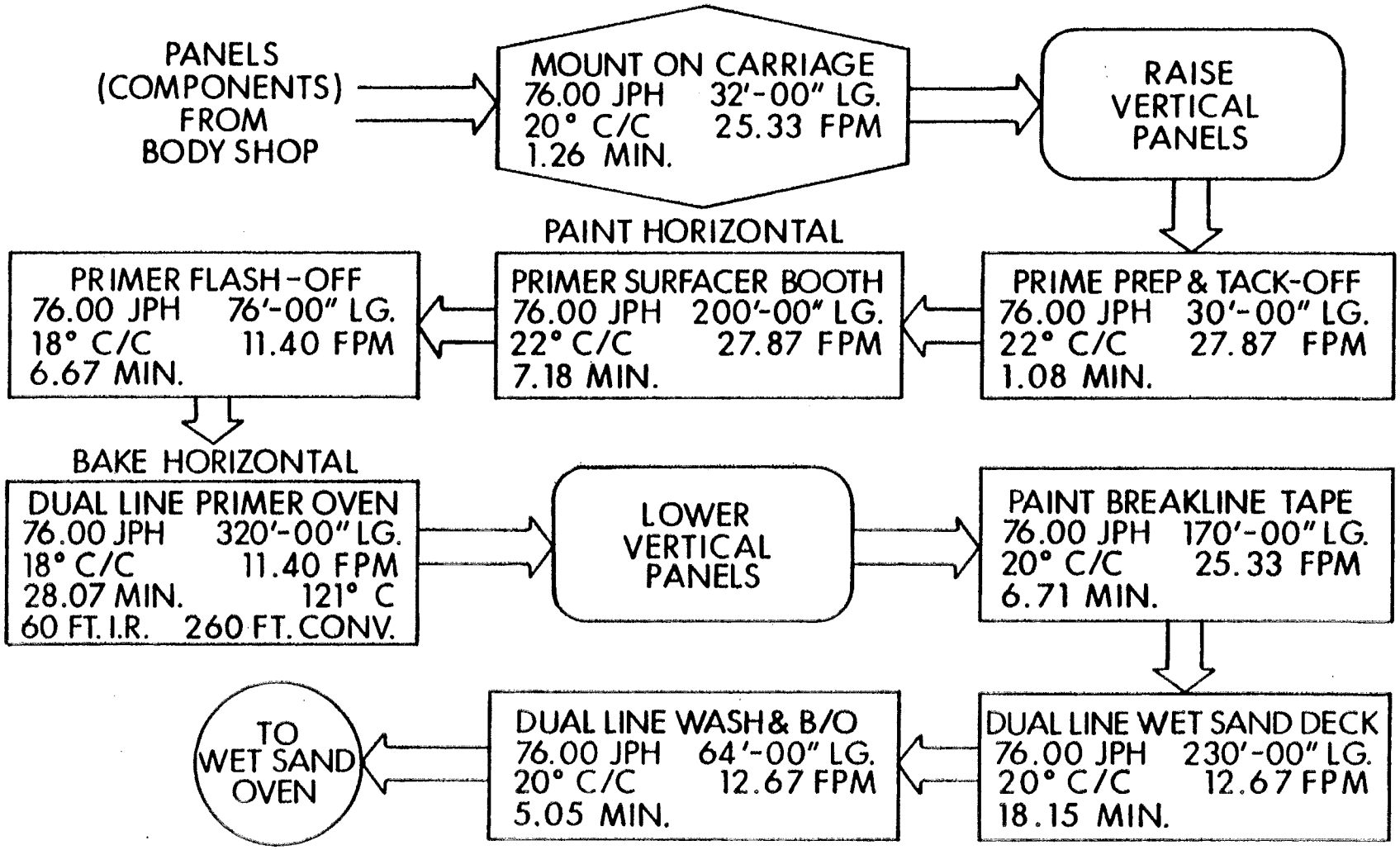
FIGS. 1A and 1B are flow diagrams depicting a process for coating components of a vehicle body.
Figure 1B:
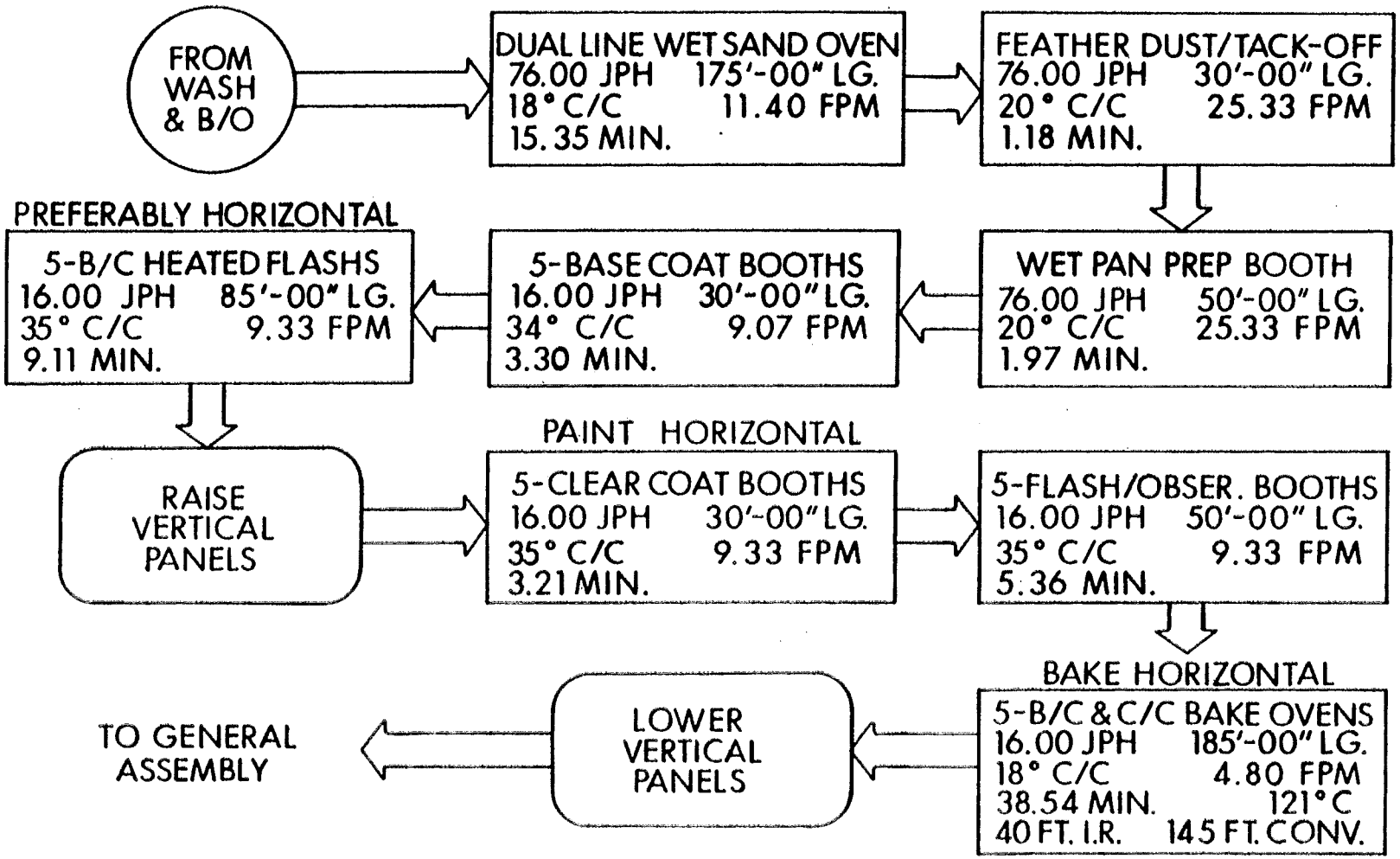
Figure 2:
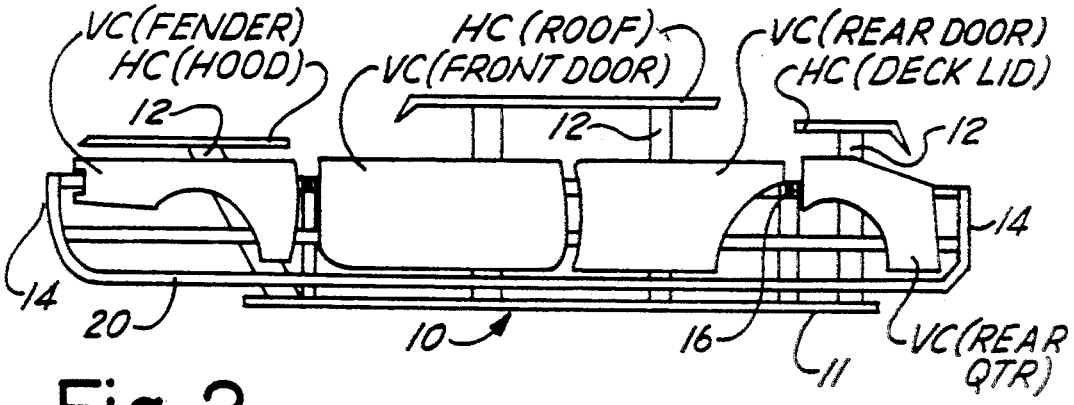
FIG. 2 is a schematic side view of a carriage used for carrying vehicle components through a coating line, and such components mounted thereon.

A typical coating line for a vehicle body includes processes for applying an undercoat, an intermediate coat (basecoat) and a top coat (clear coat). FIGS. 1A and 1B represent a flow diagram of one embodiment of the invention utilized in a coating line where body (panel) components, both horizontal and vertical, are painted prior to assembly. The terms "vertical components" and "horizontal components" generally refer to the in-body position of such components after final assembly. FIG. 1A begins with such body components being mounted or installed on a carriage 10 (FIG. 2).

The following description is for a "modular" paint shop process using the invention. However, the invention may be used in "in-line" traditional paint shops also.

Primer

The vertical components (i.e., vehicle side panels) are placed in a horizontal position and then prepared for priming by "tack-off" which removes small particles. The vertical components remain in a horizontal position for application of the primer in the primer surface booth.

Next, the carriage enters a primer flash-off station where volatile components of the primer/paint are permitted to volatilize prior to baking. In the next station, which is a dual line primer oven, the baking takes place at a temperature of approximately 129° C. and the vertical panels remain in a generally horizontal orientation. In order to facilitate movement of the carriage to the next station of the coating line, the vertical vehicle components (panels) are lowered from the horizontal position to a generally vertical position. The carriage then progresses through a number of stations which prepare the surface for application of the basecoat. These stations include: wet sanding, wash, and then heating in a drying oven at a temperature of about 129° C. A feather dust and tack-off precedes paint application. The various stations shown in FIGS. 1A and 1B include typical process parameters as follows: JPH (jobs per hour), c/c (degrees centigrade), LG (length of booth or station), FPM (feet per minute—travel speed through booth or station) and MIN (minutes—time spent in booth or station).

Base Coat

Prior to entering one of the basecoat booths, as shown in FIG. 1B, the vertically oriented vehicle component panels may be elevated to a horizontal position. Alternatively, the panels may be maintained in their generally vertical position. It is preferred to maintain the vertical vehicle component panels in their vertical position if the basecoat includes metallic, mica flakes or other such particles for which a particular orientation is achieved by application in the vertical position. If flake orientation is not a concern, the vertical vehicle components may be painted in a horizontal position in the basecoat booth in order to achieve a thicker coating and prevent sagging. After the basecoat booth, the carriage advances to a heated flash station (for water-borne paints).

Each basecoat booth is approximately 30 feet long and typically has four robots which spray paint the vehicle components. The components enter the booth on a carriage and stop with the vertical panels oriented in a desired position, and then robots paint the vehicle basecoat onto the components. This vehicle basecoat provides the color and may also include mica or metallic flakes, in which case, as stated above, a vertical orientation is desired for vertical components.

Next, the carriage advances the components to the heated flash oven. An infrared oven heats the components to a temperature on the order of 180° F. to about 220° F. for only a few minutes to volatilize the water which is present in a water-borne basecoat paint. The heated flash is generally optional if the solvent for the basecoat paint is a volatile hydrocarbon.

Topcoat (Clear Coat)

Next, the carriage advances the components to a series of clear coat booths. In a typical clear coat booth, there are four robots which paint the vehicle components. Typically, the clear coat will consist of an isocyanate-based or melamine solution. It is preferred that the vertical panels be painted in a horizontal orientation in the clear coat booth, as this will enable a thicker layer of clear coat to be applied. Alternatively, the vertical components may be painted in the clear coat booth in a vertical orientation. Then, after leaving the clear coat booth, the vertical components are rotated to an essentially horizontal orientation. Typically, prior to entering the bake oven, the carriage advances the vehicle components through an observation booth for a period of up to about seven minutes. The vertical components, if maintained in a vertical position during clear coat and observation, may then be rotated to an essentially horizontal position just prior to entry into the infrared zone of the bake oven. Preferably, the vertical components would begin to rotate toward a horizontal position in the flash observation booth and assume an essentially horizontal position, prior to entry into the infrared zone of the bake oven. If the panels are rotated to a horizontal position prior to entry into the clear coat booth and maintained in a horizontal orientation through the bake oven, this will avoid problems with dirt and dust particles being agitated by movement of the vertical component panels.

The carriage advances through about a 40 foot span of infrared zone of the bake oven for a period of about seven minutes. Then, the carriage advances through the balance of the oven, approximately another 145 feet, over a period of about 25 minutes, during which convection heating occurs. Both sections of the oven are typically gas fired. The infrared zone has radiant walls which are heated on a backside by hot gas and which radiate energy to the components (infrared heating). Convection blowers blow hot air onto the component panels in the convection zone.

An important advantage of the method of the invention is that at the high temperatures of the bake oven, gravity will not cause sagging of the clear coat because the vertical components are in a horizontal position while in the bake oven. Therefore, since all components are brought up to the horizontal position for baking, it is not necessary to overcome the effects of gravity. This is an important advantage because, presently, application of automotive paints to vertical vehicle components requires that rheology of the paint be controlled so that the paint is more viscous, more adhesive and less likely to sag when applied to side panels or vertical components. The method and apparatus of the invention avoids the complex problem of paint rheology control.

Figure 3:
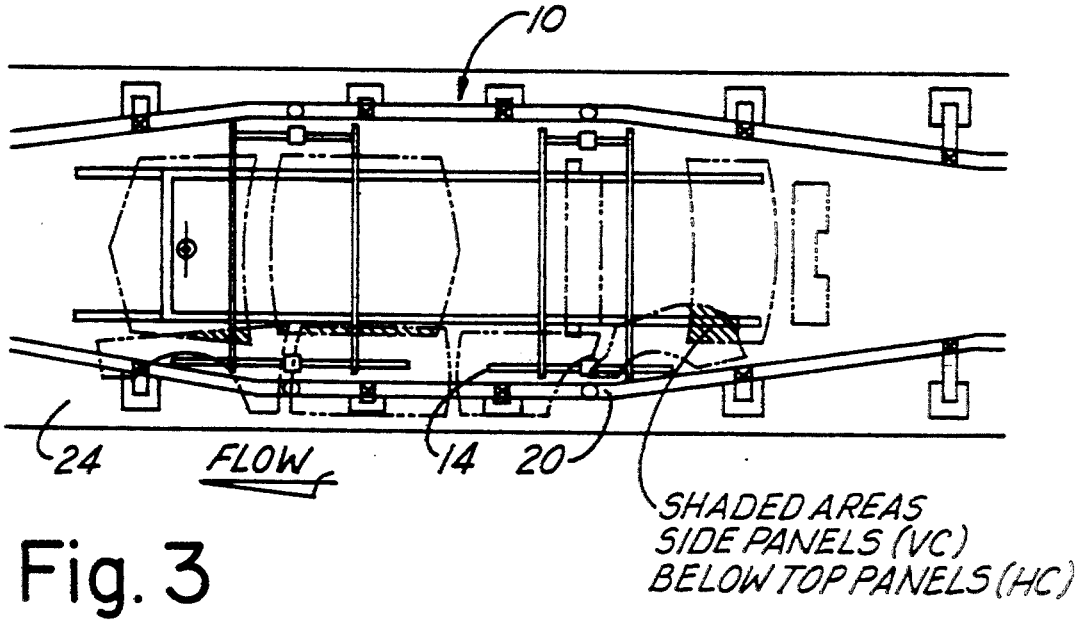
FIG. 3 is a top view of the carriage of FIG. 2.

A preferred carriage for transporting horizontal and vertical components of a vehicle body is as shown in FIGS. 2 and 3. The carriage 10 comprises a base 11, which may be in the form of a platform mounted on wheels, and moveable by a conveyor, guide vehicle or the like. The base 11 carries at least one first fixture 12 which is preferably a vertical support. At least one second fixture 14 is a moveable support which rotates and which is "operably" connected to the base by mounting means 16 which permits the second fixture 14 to rotate. If desired, the second fixture 14 may be carried by the first fixture 12.

In this case, the mounting means 16 connects the moveable second fixture 14 to the vertical support of the first fixture 12. When the second fixture 14 is rotated to a transverse position relative to a first position, the vertical vehicle component is disposed in a generally horizontal plane. When the second fixture 14 is rotated in the opposite direction, the second fixture 14 aligns the vertical vehicle components (VC) in a generally vertical plane, consistent with its in-body position. Guide means 20 are provided for causing the rotational movement of the second fixture 14 to assume its generally vertical orientation or generally horizontal orientation, or to any position or angle therebetween.

Figure 4:
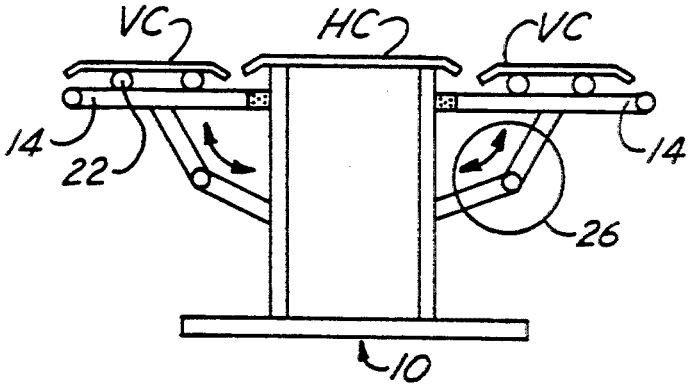
FIG. 4 is an end view of the carriage of FIGS. 1A and 1B with the vertical panels retained in their horizontal position.

Vertical vehicle components are supported on the second fixture 14 by retaining means 22 (FIG. 4) which releasably retain such components on the carriage 10 as they advance through the coating line. Horizontal vehicle components are mounted preferably on top of one or more of the first fixtures 12 and releasably retained thereon. In use, as the carriage 10 advances through a spray painting booth, the first fixtures 12 retain the vehicle hood, roof and deck lid in a generally horizontal position. At the same time, the second fixtures 14 retain the vehicle fender, doors and quarter panels in any desired orientation as the carriage progresses through the coating line.

The guide means for rotating the second fixture 14 to various positions preferably consist of rails 20 which move within a trough 24 on each side of the carriage 10. In one embodiment, the trough is angled upward as the carrier moves forward, which causes the guide rail 20 to slowly raise the second fixture 14, thereby extending the second fixture 14 to a generally horizontal position, which is the preferred position for the bake cycle. If desired, a spring or spring-loaded arm 26 (FIG. 4) may be used to facilitate extension of the second fixture 14 to the vertical position when the guide rails 20 are angled upward. At the end of the bake cycle, or some portion thereof, the guide rails 20 advance through another set of troughs 24 which are angled downward so that as the carriage 10 advances, the guide rails 20 move downward, causing the second fixture 14 to assume a generally vertical orientation. At a fully retracted position, corresponding to a fully vertical orientation, a spring may snap the second fixture 14 into place.

Various other activator means may be used to cause movement of the second fixture 14. For example, carriage 10 may incorporate a cam which is adjusted to rotate the moveable second fixture 14 between an essentially horizontal and an essentially vertical orientation.

The relatively flexible design of the carriage 10 enables it to proceed through various operations of the plant with the second fixtures 14 in a retracted or generally vertical position. This allows for maximum floor space utilization in the plant in areas where component panel orientation is not critical. Thus, in the retracted (generally vertical) position, the second fixtures 14 of the carriage 10 proceed through an existing coating line without modification of existing conveyers or booths. Preferably, when conveyed in the generally vertical position, each second fixture 14 is fixed with a "latch ledge" down clip that ensures that the second fixture 14 maintains a fully retracted (generally vertical) position while travelling through the plant facility. Upon entering the coating line, the second fixtures 14 may be unlatched to allow movement. Then, the carriage proceeds through the coating line, as described in connection with FIGS. 1A and 1B above.

The moveable second fixtures 14 may be oriented in any desired position, at any predetermined point along the coating line. Typically, they will be in a generally vertical position during application of a basecoat containing metallic or mica flakes, in order to duplicate the orientation of such flakes in the assembled body. If flake orientation is not of concern, the moveable second fixtures 14 may extend the vertical components to the horizontal position before or during the basecoat application process. This position may remain unchanged when the carrier moves the vehicle components from the basecoat section of the coating line to the clear coat paint booth. If basecoat is applied with vertical components in the generally vertical position, the vertical components may be moved to a horizontal position for application of the clear coat. The horizontal position advantageously permits a thicker coating to be applied without sagging, as may occur when such clear coat is applied to vertical components oriented in a vertical position. Alternatively, the clear coat may be applied with the vertical components in their in-body or vertical orientation and, at the exit of the clear coat booth, the carrier guide rails 20 would slide into an upwardly angled trough 24. This causes the second fixtures 14 to orient the vertical panels to a horizontal position for baking.

Preferably, at the end of the last bake cycle of the coating line, the second fixtures 14 encounter a set of troughs angled downwardly, so as to urge the moveable supports downward to dispose the vertical components in a generally vertical orientation. When the moveable supports are essentially fully retracted (vertical position), preferably a spring snaps the moveable supports into a latch on the carrier which locks the moveable supports in position.

Advantageously, the carriage has a simple design and easy to use means for rotating vertical vehicle components from one position to another. It avoids the need for rotating an entire vehicle body, as is required in the present art. Further, since the moveable supports (fixtures) of the carriage permit rotation without changing the orientation of the horizontal vehicle components, there will be, in some cases, no need to reconfigure the paint booth or the bake ovens to accommodate the carriage of the invention. When a horizontal position is not required for a particular step in the coating process, the carriage of the invention makes it possible to simply rotate the vertical components back to a generally vertical orientation where they occupy less space.

The carriage may be of skid, truck or other design. Metal body panels may not require a backing and may be fitted directly to the supports of the carriage. Composite panels should be mounted on forms to provide a heatsink and be latched in place with mechanical hold-downs. Preferably, horizontal panels are mounted on fixed tubing extending from the center of the carrier which constitutes the first fixture 12. Preferably, the carriage has a right moveable support and a left moveable support corresponding to each side of a vehicle. Construction material of the carriage is preferably of round tubing to prevent dirt build-up and paint accumulation while in use. Preferably, a spring-loaded hinge attaches the moveable second fixture 14 to the base 11 or to the first fixture 12. Preferably, each second fixture 14 is equipped with a respective extendable support which maintains the second fixture 14 in the extended or essentially horizontal position.

The key advantage of the method of the invention is that it is possible to obtain a high quality finished coating without surface irregularities (orange peel) in vertically oriented body parts. This finish is equivalent to the surface finish obtainable in horizontally oriented body parts. Another advantage is that less rheology control is required which improves the finish of both the horizontal vehicle panels and the vertical vehicle panels whereby a thicker dry film is achieved.

One measure of the quality of the finish is tension, which is measured by using a polaroid camera and a projected grid pattern which becomes wavy if the surface contour of the coating is irregular or orange peeled. If the projected grid is clear, then the surface is essentially smooth and achieves the highest rating of 20. A rating of 20 tension is equivalent to polished black glass, so that if the surface of a car had a coating which achieved a 20 tension, it would be equivalent to looking in a mirror with no distortion or orange peel. For a typical vehicle, the tension rating is usually about 14 to 16 on horizontal components, and 12 to 14 on vertical components. In contrast, the method of the invention permits one to achieve a tension rating close to 19 or 20 for both horizontal and vertical components. Obviously, the attainment of a high rating for vertical components is key as their present rating is so much lower than that of the horizontal.

The thickness of the coating will also be improved using the method of the invention. The thickness of the coating can be increased because the vertical components may be either coated in a horizontal position or rotated to a horizontal position immediately after coating to prevent sag and reduce orange peel. Presently, clear coat thickness of about 1.8 mills is achieved with present systems. By the method of the invention, a 2.5 mill coating is possible on both horizontal and vertical components. Presently, two applications of primer coat are done in order to build up the thickness of the primer base. Extra thick primer cannot presently be added all at one time because of problems with sagging and orange peel. The process of the invention enables one to orient the vertical panels in a horizontal position for the application of primer in one step, to achieve the desired thickness. The elimination of one set of primer apparatus, including bake oven, prep booth and the like, and the elimination of the need to double clear coat, as is presently done in some cases, results in the savings of tens of millions of dollars per plant site.

While this invention has been described in terms of certain embodiments thereof, it is not intended that it be limited to the above description, but rather only to the extent of the spirit and scope of the following claims.

The embodiments of the invention in which an exclusive property or privilege is claimed are defined as follows:

1. In a method for coating selected surfaces of horizontal and vertical body components of a vehicle in a coating apparatus, the vertical body components having outwardly curved surfaces to be coated, where the designations horizontal and vertical components refer to the in-body position of such body components after final assembly, and wherein the coating is applied and then the coating is set by baking conducted prior to such assembly, the improvement comprising, after such coating application and before such setting, disposing the vertical components in a generally horizontal position with the outwardly curved coated surfaces thereof facing upward and maintaining such position while heating to a temperature sufficient to set the coating.

2. The improvement according to claim 1 wherein the coating is applied while maintaining the vertical components oriented in a generally vertical position and wherein the vertical components are disposed in a generally horizontal position immediately before heating.

3. In a method for coating selected surfaces of horizontal and vertical body components of a vehicle in a coating apparatus, the vertical body components having outwardly curved surfaces to be coated, where the designations horizontal and vertical components refer to the in-body position of such body components after final assembly, and wherein the coating is applied and then the coating is set by baking conducted prior to such assembly, the improvement comprising:

a) supporting the horizontal and vertical components on a carriage constructed and arranged to rotate the vertical components from a first position to a second position, the first position being one of substantially horizontal and substantially vertical and the second position being the other one;

b) advancing the carriage supporting the components through the coating apparatus;

c) adjusting the vertical components to a position between and including the first and second positions while maintaining the horizontal components in an essentially horizontal orientation; and d) positioning the vertical components in a generally horizontal position with the coated outwardly curved surfaces thereof facing upward before or during baking and maintaining such horizontal position until the coating is set.

4. The improvement according to claim 3 wherein the coating is applied while maintaining the vertical components oriented in a generally vertical position and wherein the vertical components are adjusted to a generally horizontal position immediately before baking.

5. The improvement according to claim 3 wherein the coating apparatus comprises, in sequence, paint application apparatus and paint baking apparatus and wherein the vertical components are oriented in an essentially vertical position while advancing through the painting apparatus, and then rotated to an essentially horizontal position for advancement through at least a portion of the baking apparatus.

6. The improvement according to claim 5 wherein the paint applied is a clear coat or a top coat.

7. In a method of coating selected surfaces of horizontal and vertical body components of a vehicle in a coating apparatus, where the designations horizontal and vertical components refer to the in-body position of such body components after final assembly, and wherein the coating is applied and then the coating is set by baking conducted prior to such assembly, the improvement comprising:

a) supporting the horizontal and vertical components on a carriage constructed and arranged to rotate the vertical components from a first position to a second position, the first position being one of substantially horizontal and substantially vertical and the second position being the other one;

b) advancing the carriage supporting the components through the coating apparatus, which comprises, in sequence, a first set of paint application and baking apparatus which applies base coat having metallic or mica particles, and a second set of such application and baking apparatus which applies a clear coat and wherein the vertical components are oriented in an essentially vertical position while advancing through the first set of apparatus, and then placed in an essentially horizontal position with the coated surfaces thereof facing upward for advancement through the paint baking portion of the second set of apparatus until the clear coat is set while maintaining the horizontal components in an essentially horizontal orientation.

* * * * *